United States Patent [19]

Morton

[11] 4,262,413

[45] Apr. 21, 1981

[54] METHOD AND APPARATUS FOR MAKING AN ELECTRICAL COIL WITH INSULATED LEAD STRUCTURE

[75] Inventor: James W. Morton, Hickory, N.C.

[73] Assignee: General Electric Company, Phila, Pa.

[21] Appl. No.: 34,793

[22] Filed: Apr. 30, 1979

[51] Int. Cl.[3] ..... H01F 41/10; H01R 43/00

[52] U.S. Cl. ..... 29/605; 29/564.4; 29/855; 29/860

[58] Field of Search ..... 29/605, 628, 25.42, 29/564.4, 854, 860, 855; 336/192

[56] References Cited

U.S. PATENT DOCUMENTS

| | | | |
|---|---|---|---|
| 2,534,119 | 12/1950 | Gethman | 336/192 |
| 2,845,693 | 8/1958 | Shetterly et al. | 29/628 |
| 3,060,073 | 10/1962 | Horn | 336/192 X |
| 3,363,309 | 1/1968 | Logan et al. | 29/628 |
| 3,412,450 | 11/1968 | Whiteman et al. | 29/605 X |
| 3,488,839 | 1/1970 | Proxmire | 29/605 |
| 3,527,138 | 9/1970 | Boltz | 29/628 X |
| 3,534,312 | 10/1970 | Grasinger | 336/192 |
| 3,596,843 | 8/1971 | Lightner et al. | 336/192 X |
| 3,925,885 | 12/1975 | Smith | 29/605 |
| 3,961,417 | 6/1976 | George | 29/605 |

*Primary Examiner*—Carl E. Hall
*Attorney, Agent, or Firm*—William Freedman

[57] ABSTRACT

This method makes an electrical coil from conductive wire having an insulating coating bonded thereto and provides the coil with at least one conductive lead. The coil winding operation is stopped when a predetermined wire region is located at a work station, where a section of the insulating coating is removed, thereby exposing a section of bare wire. Then there is placed in contact with the section of bare wire and cold-welded thereto a thin conductive strap that extends transversely of the wire and forms said lead. Then the cold-weld joint and a portion of the lead are covered with electrical insulation by applying to opposite faces of the lead two strips of insulating material that extend transversely of the wire on opposite sides of the wire. Then the strips are bonded together, following which the winding operation is continued to complete the coil with said strips extending generally parallel to the coil axis.

Apparatus is provided for automatically carrying out this coil-making and lead-applying method. Also the coil structure that is made by this method is disclosed and claimed.

13 Claims, 16 Drawing Figures

150
154
152
160
162
156
158
161
$S_1$ 160
162
158
154
156
161
$S_2$ 162
160
158
156
154
161

METHOD AND APPARATUS FOR MAKING AN ELECTRICAL COIL WITH INSULATED LEAD STRUCTURE

BACKGROUND

This invention relates to a method and apparatus for making an electrical coil from conductive wire having an insulating coating bonded thereto and, more particularly, relates to a method and apparatus for providing such a coil with one or more leads that are covered over a portion of their length with electrical insulation. This invention is also concerned with insulated lead structure for such a coil that is so constructed as to readily lend itself to manufacture by a substantially completely automated method.

A typical method that is presently used for making such coils and applying insulated leads thereto is the so-called loop-out method. In this method, a coil winding machine winds the wire into a coil while pulling it past a work station. The winding operation is stopped when a predetermined region of the wire is located at the work station. Then an operator pulls slack into the wire and folds, or loops, this slack out to form in the conductor a loop that will subsequently serve as the desired lead. This loop is then taped in place on the coil, following which a slotted insulating tube is slipped over the loop and is also taped in place. Then the coil winding operation may be resumed.

The above-described looping, taping, and tube-applying steps are manual operations which require considerable time and attention to complete in a satisfactory manner, thus adding substantially to the cost of the resulting coil.

An object of my invention is to construct the insulated lead structure in such a way that it can be produced automatically and without manual intervention and at greatly reduced cost as compared to the cost of the above-described manual procedure.

I am aware of completely automatic methods and apparatus for applying leads to foil, or strip conductor, as the foil is being wound into a coil. See, for example, U.S. Pat. Nos. 3,412,450—Whiteman et al and 3,596,843—Lightner et al. But many of the problems involved in making a coil from wire and particularly from wire having bonded insulation, e.g., enamelled wire, are quite distinct from those involved when the conductor is strip conductor or foil, which typically has a width equal to the axial length of the coil that is being wound. For example, when working with wire having bonded insulation, the tenaciously-adhering bonded insulation usually must first be removed before a separate lead can be attached to the wire. Foil, on the other hand, usually has a bare surface to which the lead can be readily attached. Also, the insulation used for the lead must be quite different in a wire-wound coil, particularly if the lead is a tap located intermediate the ends of the coil. In a wire-wound coil, if the tap is located on an internally-located turn in one layer of coil, the tap must usually extend across and closely adjacent other turns of this layer and must be well insulated from such other turns. But in the foil-wound coil, each layer constitutes a turn, and a tap can extend across the entire width of the layer to which it is attached without necessitating the provision of any insulation between the layer and the tap. This extra insulation required with the taps in a wire-wound coil tends to produce a greater build-up in coil diameter when taps are included in a wire-wound coil than is the case with a foil-wound coil. Moreover, if the tap extends across the entire width of a layer, as in the foil-type coil, the presence of the tap beneath surrounding layers of coil does not cause a non-uniform build-up in the coil diameter across the width of the layers. But in a wire-wound coil, the tap may extend across only a portion of the layer width, thus giving rise to the problem of a non-uniform build-up in core diameter along this layer-width dimension.

SUMMARY

Accordingly, another object of my invention is to provide a method for applying leads to coils made from wire with bonded insulation, which method readily lends itself to being highly automated.

Another object is to provide a method that fulfills the immediately-preceding object and which also results in: (a) exceptionally low build-up in coil diameter as a consequence of the inclusion of insulated taps and (b) any build-up which does occur being substantially uniform along the width of the coil layers.

Another object is to provide apparatus capable of automatically performing the methods set forth in each of the two immediately-preceding paragraphs.

In carrying out the invention in one form, I provide the following method for making a coil from conductive wire having an insulating coating bonded thereto and for providing the coil with at least one conductive lead. The coated wire is wound about a coil axis while being advanced along its length past a work station. The winding operation is stopped when a predetermined wire region is located at the work station. A section of the insulating coating is removed from said wire region, thereby exposing a section of bare wire at the work station. Then, there is placed in contact with the section of bare wire a thin conductive strap that extends transversely of the wire and forms said lead. The strap is then cold welded to the bare wire section. Then the cold weld joint and a portion of the lead are covered with electrical insulation by applying to opposite faces of the lead two strips of insulating material that extend transversely of the wire for substantial distances on opposite sides of the wire. Then the strips of insulating material are bonded together. Thereafter, the winding operation is continued to further form the coil with said strips of insulating material extending generally parallel to said coil axis.

In carrying out the invention on another form, I provide a machine for performing the method of the immediately-preceding paragraph. This machine comprises a framework located at said work station and reciprocally movable in a direction transverse to the wire and said work station. Mounted on the framework is insulation-removing means, preferably comprising a rotatable tool, which is operable to remove said section of insulating coating when said framework is moved in one direction transversely of the wire. Means is provided for releasably fixing to the framework the conductive lead-forming strap so that when the framework is moved in said one transverse direction, it carries the conductive strap into a position where the strap can contact the section of bare wire. Means carried by the framework then produces the cold weld between the strap and the section of bare wire. Means acts to move the framework in an opposite transverse direction following the cold welding operation. Means is provided for releasing the strap from the framework prior to said opposite transverse motion, thus avoiding displacement of the wire by said opposite transverse motion of the framework.

In carrying out the invention in still another form, I provide the following combination in an electrical coil comprising a conductive wire wound about a coil axis in a first series of turns constituting a first tubular layer and in a second series of turns constituting a second tubular layer surrounding the first layer, the wire having an insulating coating bonded thereto but a predetermined region in the first layer that is free of said insulation along a surface that faces said second layer: (a) a thin conductive strap projecting transversely of the wire and having one end located at said predetermind region and its other end located externally of the coil at one axial end of the coil, (b) a weld joining said one strap end to said wire at said predetermined region, and (c) two strips of insulation, each comprising a first portion extending from said predetermined wire region in one direction transversely of the wire in said region and a second portion extending from said wire region in an opposite direction with respect to said wire region. The first portions of the strips are located at opposite faces of the strap, are bonded together, and enclose the strap between said wire region and said one axial end of the coil. One of said portions of the insulating strips is located radially inwardly of the first layer, and the other of said portions is located in a position between said two layers.

BRIEF DESCRIPTION OF THE DRAWINGS

For a better understanding of the invention, reference may be had to the following description taken in connection with the accompanying drawings, wherein.

DETAILED DESCRIPTION OF PREFERRED EMBODIMENTS

Winding of the Coil

Figure 1:
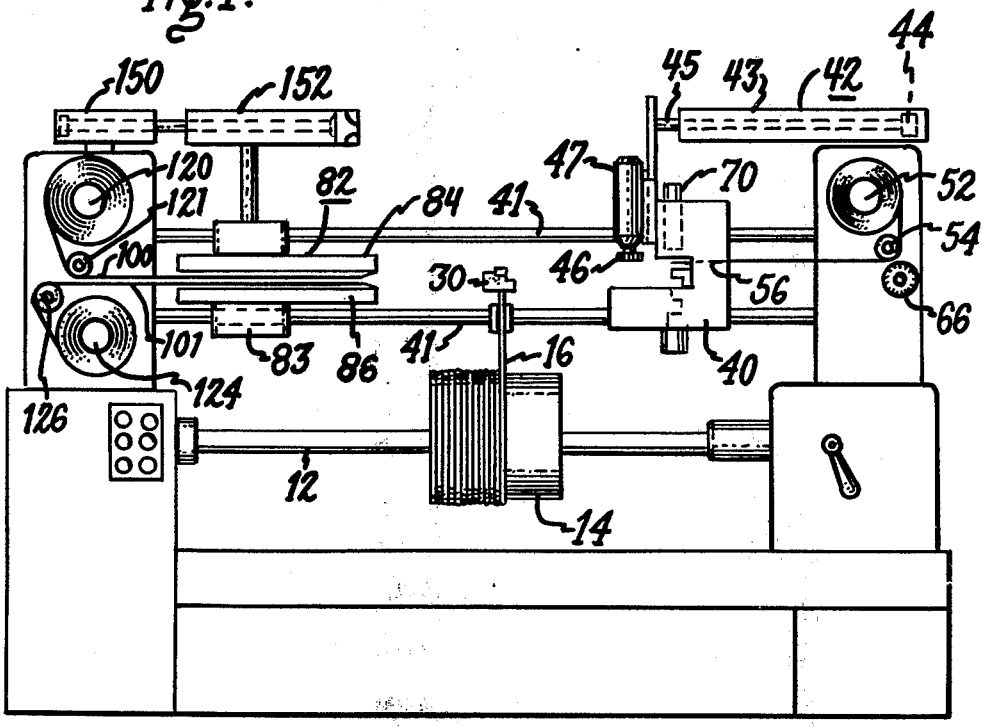
FIG. 1 is a schematic showing of coil-making apparatus embodying one form of the present invention.

Referring now to FIG. 1, there is shown coil winding apparatus that comprises a spindle 12 that is rotatably driven by a suitably controlled electric motor (not shown). Coaxially mounted on this spindle 12 for rotation therewith is a cylindrical winding form 14 on which the coil is wound. This winding form may be a separate spool of insulating material especially for this purpose or may, in the case of a distribution transformer, be constituted by the usual cylindrical low voltage coil assembly of the transformer. The coil being wound is the high voltage coil assembly of this transformer. The coil that is being wound is made from conductive wire 16 having a coating 17 of insulation bonded thereto, as will be apparent from the enlarged cross-sectional view of FIG. 1*a*. This coating is preferably of a suitable enamel that is tenaciously bonded to the conductive wire. Such wire is often referred to as magnet wire.

At the start of the coil-winding operation, one end of the magnet wire is suitably attached to the winding form 14, preferably by taping. When the winding form is driven by rotation of the spindle 12, it pulls wire from a suitable storage reel (not shown), winding it onto the form 14. In passing from the storage reel to the winding form 14, the wire 16 is led over a series of idler pulleys 20, 22, 24, and 26 (FIG. 2) that guide the wire as it moves past a work station where leads are attached in a manner soon to be described in detail.

Figure 12:
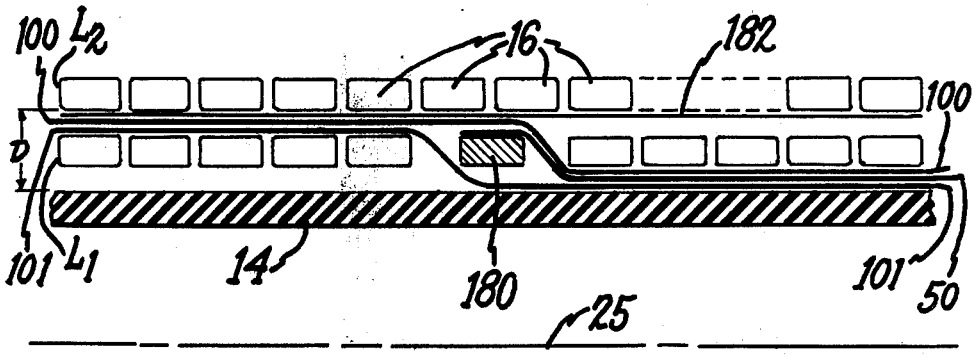
FIG. 12 is a diagrammatic, slightly exploded, sectional view of a portion of a coil having a tap applied in accordance with one embodiment of my invention.

Referring to FIG. 12, the coil is wound on the winding form 14 as an assembly comprising a plurality of concentric tubular layers, such as $L_1$ and $L_2$. Each layer comprises a plurality of series-connected turns having substantially the same diameter and encircling the axis 25 of the concentric layers. In a typical coil, there will be as many as 10 to 20, or even more, layers.

It is to be understood that each of the pulleys 20, 22, 24, 26 is mounted for axial motion as well as rotation. Such axial motion of the pulleys is controlled by a conventional traversing mechanism (partially shown in FIG. 2) that shifts all the pulleys axially as the wire is wound on the winding form 14 so that each tubular layer of the coil is constituted by turns located closely adjacent each other and at the same distance from the central longitudinal axis of the coil and so that each layer is wound proceeding in an axial direction from a starting point located where the preceding layer ended and in an axial direction opposite to that used for the preceding layer.

In general, this traversing mechanism shifts the pulleys a distance equal to one wire thickness for each revolution of the winding form 14. However, in accordance with one form of my invention, the traversing mechanism is programmed so that is shifts the pulleys two wire thicknesses at those locations where a lead is provided intermediate the length of a layer. This extra traversing motion of the pulleys will be referred to in more detail hereinafter.

Figure 2:
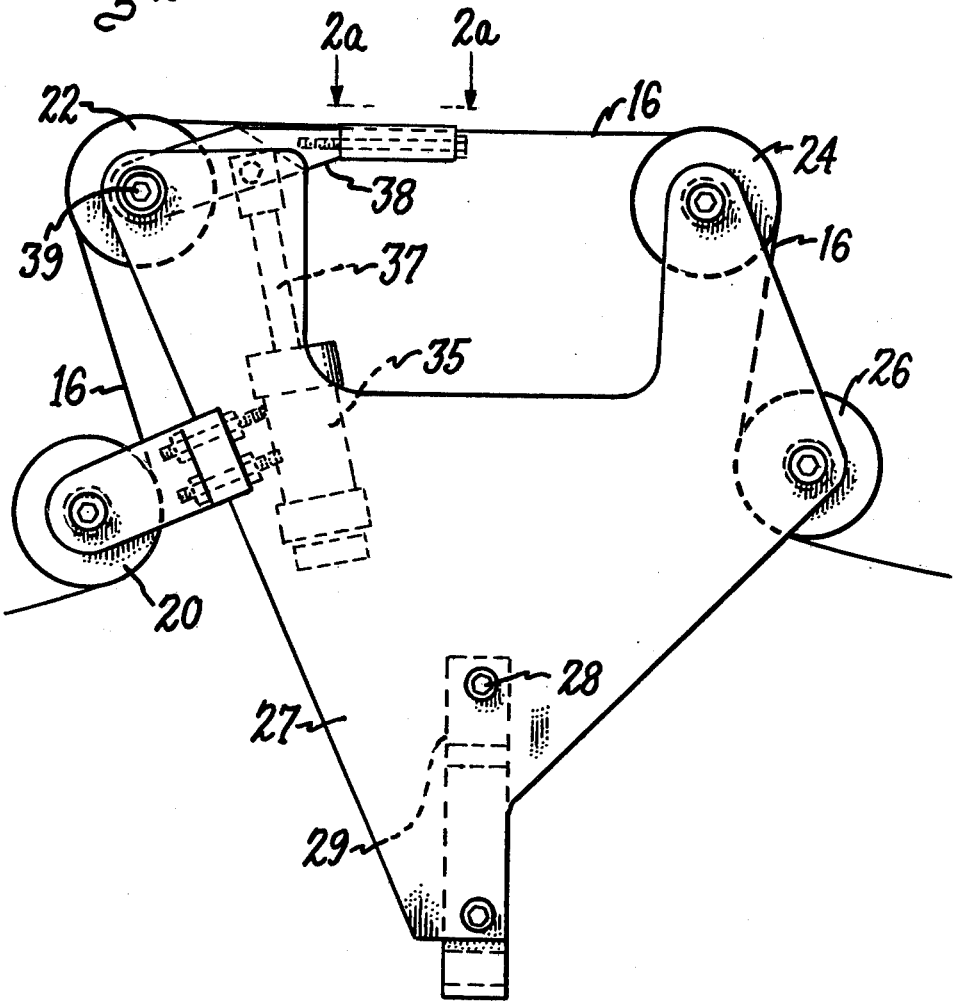
FIG. 2 is a schematic showing of the pulleys and traversing mechanism used for guiding the wire during the coil-winding operation and also of the mounting means for the anvil of FIG. 1*a*.

The portion of the traversing mechanism shown in FIG. 2 comprises a base 27 on which all four idler pulleys 20, 22, 24, and 26 are rotatably mounted, with their axes disposed in parallel relationship. During the winding operation, the base 27 is shifted in a direction parallel to the axes of the pulleys by rotation of a rotatable screw 28 that is threaded in a non-rotating traveling nut 29 carried by the base 27. Rotation of the screw 28 is suitably coordinated with rotation of the winding form 14 to provide the above-described desired traversing motion of the base 27 and the pulleys during the winding operation.

Stopping the Winding Operation and Preparing for the Attachment of a Lead

Figure 3:
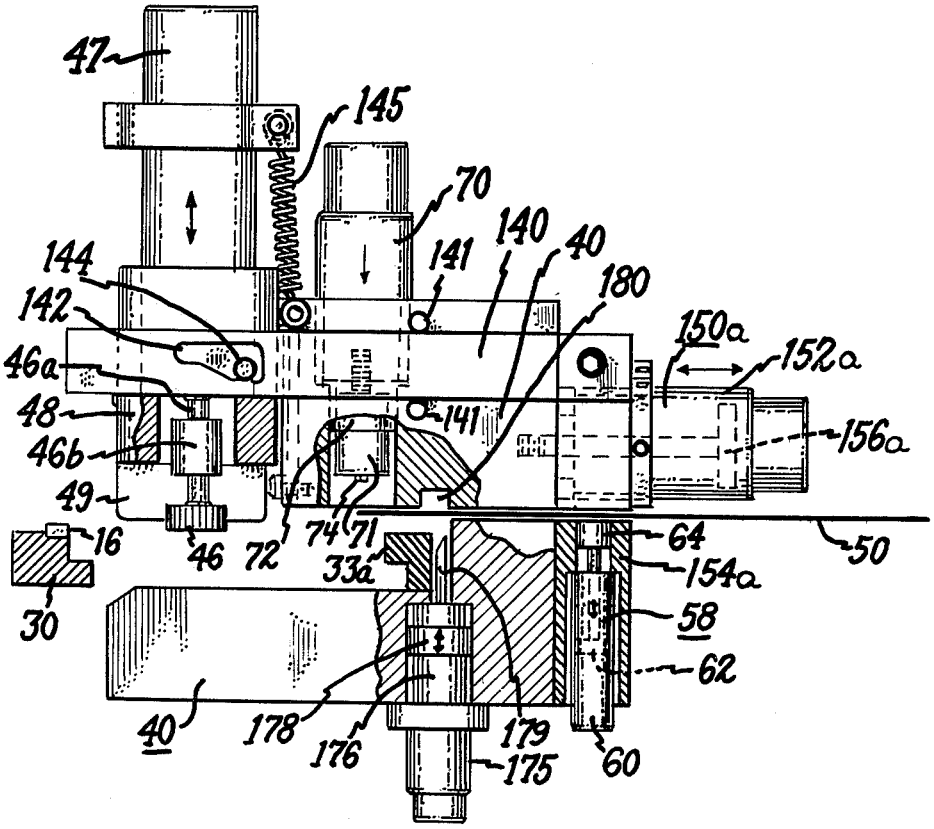
FIG. 3 is an enlarged side elevational view, partially in section, showing the portion of the apparatus of FIG. 1 used for removing insulation from a section of the wire and for applying a lead thereto. The device of FIG. 3 is illustrated in its normal-at-rest position to the right of the wire.

When a predetermined region of the wire 16 has entered the work station location, the winding operation is stopped by conventional control means (not shown) that deenergizes and brakes the driving motor. Referring to FIG. 2, when the wire has been stopped, a cold weld anvil 30 is lifted from a retracted position where its upper face engages the lower side of the wire. As shown in FIGS. 2 and 3, the anvil 30 has a groove 32 in its upper face that receives the wire 16 when the anvil is in its raised position, thus restraining the wire against horizontal displacement transversely of the wire.

To assure that the groove 32 will be properly positioned to receive the wire 16 when the anvil 30 is raised, the anvil and its operating means 34–37 (soon to be described) are carried by the base 27 of the traversing mechanism. Accordingly, when the wire 16 is shifted through its traversing motion (by shifting of the base 27 and the guide pulleys 20–26 thereon), the anvil 30 shifts transversely to the same extent as the wire. Thus, when the anvil 30 is raised, its groove 32 will align with and receive wire 16.

Figure 1A:
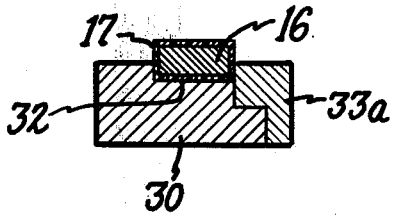
FIG. 1*a* is an enlarged cross-sectional view of the wire to which a lead is to be applied shown seated on the anvil where the lead is applied.
Figure 2A:
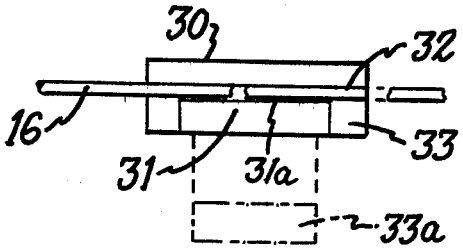
FIG. 2*a* is a plan view of the anvil as seen from line 2*a*—2*a* of FIG. 2.

Referring to FIG. 2*a*, it will be noted that the anvil 30 has a recess 31 in its central region; and in this central region, the groove in the anvil has only a bottom and one sidewall. At its lateral edges, however, the anvil has guide portions 33 where the groove is made of a three-sided configuration to facilitate guiding and holding the wire 16. Movable into the recess 31 when the anvil has been raised is a stop block **33*a* fixed to the framework 40 (soon to be described) that is used for welding of the leads after the anvil has been raised and just prior to a lead-welding operation (soon to be described), this stop block 33*a* moves into recess 31 and into contact with the inner wall 31*a*** of the recess. Here, as shown in FIG. 1*a*, the top edge of the stop block serves as a sidewall of the groove 32 and thus assists in holding the wire 16 in place during the subsequent lead-welding and insulation-application operations.

For raising and lowering the anvil 30, a fluid motor 34 (shown in FIG. 2) is provided. This motor comprises a cylinder 35 carried by base 27 and a piston (not shown) in the cylinder that can be raised by pressurizing the cylinder space beneath the piston. A piston rod 37 interconnects the piston and an arm 38 that carries the anvil 30 and is itself pivotally mounted on base 27. Referring to FIG. 2, when the piston rod 37 is driven upwardly, it pivots the arm 38 in a counterclockwise direction about its pivot axis 39, raising the anvil 30 to its position of engagement with the lower side of wire 16, locating the wire within groove 32. A suitable stop (not shown) limits upward motion of the anvil at the desired position.

The Framework 40 and the Milling Cutter 46

Referring to FIGS. 1 and 3, located at the same work station as the anvil 30 is a framework 40 that is movable transversely of the wire 16 on suitable guides, e.g., the spaced horizontal rods 41 of FIG. 1. A fluid motor 42 (schematically depicted in FIG. 1) is provided for effecting such transverse motion of the framework 40. As shown in FIG. 1, this motor 42 comprises a stationary cylinder 43 and a piston 44 slidable within the cylinder 43 and coupled to the framework 40 through a piston rod 45. When the cylinder space to the right of the piston 44 is pressurized, the piston 44 is driven to the left from its position of FIG. 1, carrying the framework 40 to the left through its normal forward stroke. This leftward motion continues until the stop block **33*a* on the framework 40 engages the anvil 30**, as may be seen in FIG. 4.

The framework 40 carries on its forward end a rotatable milling cutter 46. This cutter 46 is rotationally driven about a vertical axis by a suitable rotary air motor, the outer housing of which is shown at 47.

The milling cutter 46 is coupled to the rotor (not shown) of the air motor through a drive shaft **46*a* and a suitable chuck 46*b*. Drive shaft 46*a* is suitable journaled in a cutter housing 48 that can be raised and lowered with respect to the rest of framework 40, thereby raising and lowering the milling cutter 46. Cutter housing 48 is fixed to the air motor housing 47** so that these two housings move together.

A gage member 49 for controlling the depth of cut of the milling cutter 46 is provided at the lower surface of housing 48. In adjusting the machine initially, the bottom surface of this gage member 49 can be vertically aligned with the top surface of the fully-coated wire 16 on the anvil 30, and the milling cutter 46 can then be adjusted so that its bottom surface projects beneath the bottom surface of the gage member 49 by the desired depth of cut.

Shifting means (soon to be described) is provided for raising and lowering the cutter housing 48 together with the milling cutter 46. This shifting means acts to position the milling cutter in its lowered position while the framework 40 is being moved to the left, i.e., through its normal forward stroke transversely of the wire 16. As a result, during this forward stroke, the rotating milling cutter 46, in passing across the wire 16, machines off a section of enamel coating from the top face of the wire, leaving the top face of the wire bare at this section.

Positioning the Strap for Welding

Figure 4:
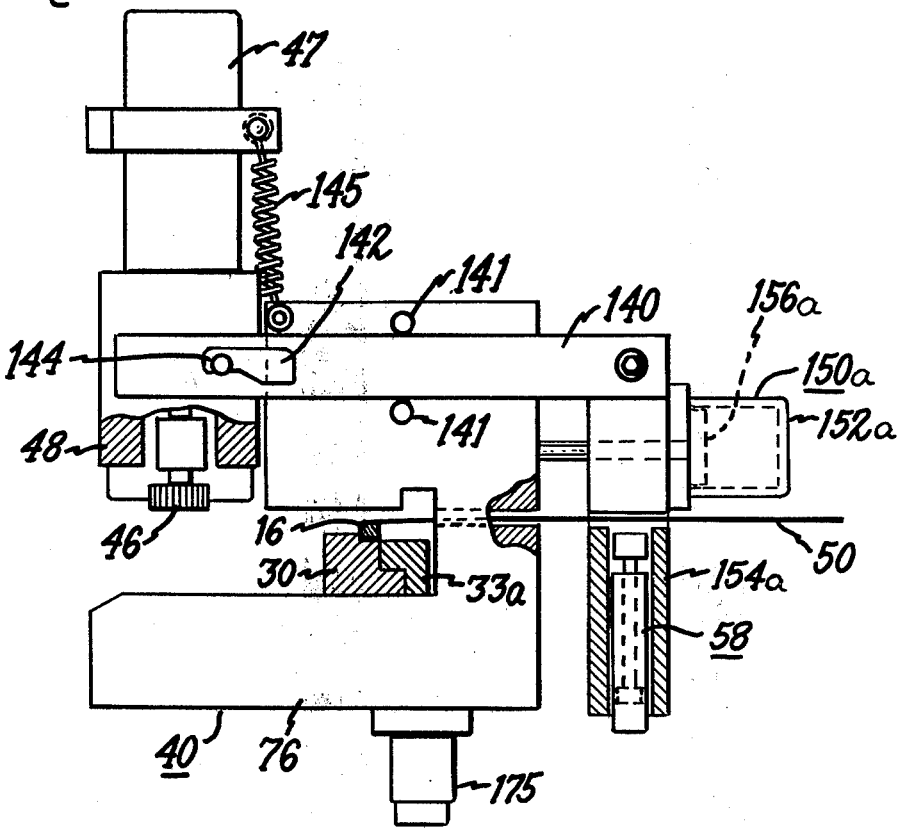
FIG. 4 shows the device of FIG. 3 after it has been moved to the left to remove insulation and attach the lead and also after the milling cutter has been raised in preparation for returning the device of FIG. 4 to the right to its normal-at-rest position of FIG. 3.

The above-described forward stroke of the framework 40 also serves to carry a conductive strap 50 into a position where its forward end is located just above the wire 16 and the lower face of the strap at its forward end is adapted to contact the bare upper surface of the wire. Referring to FIG. 1, the strap material is carried on a reel 52, and as it is unwound from the reel 52, it passes over a pulley 54 and enters a slit 56 in the framework 40. Referring to FIG. 3, a clamping device 58 located near the right hand edge of framework 40 is operable to releasably fix the strap 50 to the framework 40. This clamping device comprises a cylinder 60, a plunger 62 slidable within the cylinder, and a clamping shoe 64 at the upper end of the plunger. When the plunger is raised by pressurizing the cylinder space beneath it, the shoe 64 forces the strap upward a short distance, clamping it to the framework. This clamping occurs just before the framework 40 moves through its forward stroke, thus enabling the forward stroke to carry along the strap 50 and to position the forward end of the strap 50 above the wire 16 as shown in FIG. 4.

The strap material 50 is prepared for the welding operation that is to follow by wire-brushing its lower face as it moves past the pulley 54. This wire-brushing is performed by a stainless steel wire brush 66 (FIG. 1) that is rotated at high speed whenever the framework 40 is moved through its forward stroke. The strap material 50 is preferably of aluminum, and this wire-brushing serves to remove oxide and other contaminants thereon in preparation for the cold-welding operation that is to follow.

Cold-Welding of Strap 50 to Wire 16

When the cleaned strap 50 has thus been positioned with its left hand end over the wire 16, it is cold-welded to the wire 16 by a conventional cold-welding operation. Such cold-welding is effected by pressure-applying means in the form of a cylinder 70 (FIG. 3) carried by the framework 40 and a plunger 72 slidable in the cylinder. The plunger 72 is driven downwardly by pressurizing the cylinder space above it, and this forces the lower face of the strap 50 downwardly into engagement with the bare upper face of wire 16.

The plunger 72 carries at its lower end a die 71 having a plurality of (e.g., three) small downwardly-extending projections 74 thereon located at spaced points along the length of the wire. When the plunger 72 moves downwardly, the strap 50 and the wire 16 are sandwiched under high pressure between the die 71 and the anvil 30; and the projections 74 thus indent the strap and the wire. This indentation produces metal flow at the interface of the strap and the wire, which results in the desired cold-weld being developed between these parts.

To aid in supporting the anvil 30 during the cold-welding operation, the framework 40 is made of a generally C-shaped form and, thus, includes a rigid projecting leg 76 that is positioned immediately beneath the anvil 30, as shown in FIG. 4, during the cold-welding operation.

Resetting of Framework 40 after Cold-Welding Operation

After the cold-welding opration has been completed, the plunger 72 is restored to its normal upper position by venting the cylinder space above it and allowing a spring (not shown) to restore it to its normal upper position. When the plunger 72 has thus been raised and certain other preparatory steps (soon to be described) have been performed, the framework 40 is restored to its normal position by venting the cylinder space in cylinder 43 (FIG. 1) to the right of piston 44 and pressurizing the cylinder space to the left of piston 44, thus driving the framework 40 to the right back to its normal position of FIGS. 1 and 5.

Preparatory Steps Prior to Resetting of Framework 40 to Its Normal Position

Prior to the above-described resetting motion of the framework 40 to the right, the milling cutter 46 must be raised a short distance to allow it to clear the strap 50 and the cold-welded joint when the framework is moved to the right. Such raising of the milling cutter 46 is effected by movement of an actuating bar 140 carried by, but horizontally movable with respect to, framework 40. Suitable guides 141 prevent vertical motion of actuating bar 140 with respect to the framework 40. This actuating bar 140 has a cam slot 142 at its left hand end that receives a pin 144 fixed to the cutter housing 48. Thus, when actuating bar 140 is moved to the right from its position of FIG. 3 with respect to the framework 40, the cam slot 142 lifts the pin 144, and hence the cutter housing 48 and the milling cutter 46 move into their position of FIG. 4. This lifting action is against the opposing bias of a tension-type reset spring 145.

For driving the actuating bar 140 to the right, as above described, a fluid motor 150*a* is relied upon. This motor 150*a* comprises a cylinder 152*a* carried by a subframe 154*a* which constitutes a part of framework 40 but is horizontally movable with respect to the main portion of the framework 40. Cylinder 152*a* slidably receives a plunger 156*a* that is fixed to the main part of the frameowrk 40. When the cylinder space to the right of plunger 156*a* is pressurized, the resulting force drives the cylinder 152*a* and subframe 154*a* to the right, thus carrying the actuating bar 140 to the right, as above described, to lift the milling cutter 46.

Just before the subframe 154*a* is driven to the right with respect to the main portion of frame 40, the clamping device 58 is operated to release strap 50. Thus, the subframe 154*a* can move through this rightward motion with respect to the main portion of frame 40 without affecting the position of strap 50.

While the strap 50 is thus unclamped and the milling cutter 46 is thus raised, the entire framework 40 (including subframe 154*a*) is moved to the right from its position of FIG. 4 to its position of FIG. 5, as has already been described hereinabove under "Resetting of Framework 40 after Cold-Welding Operation".

The Application of Insulation

Figure 5:
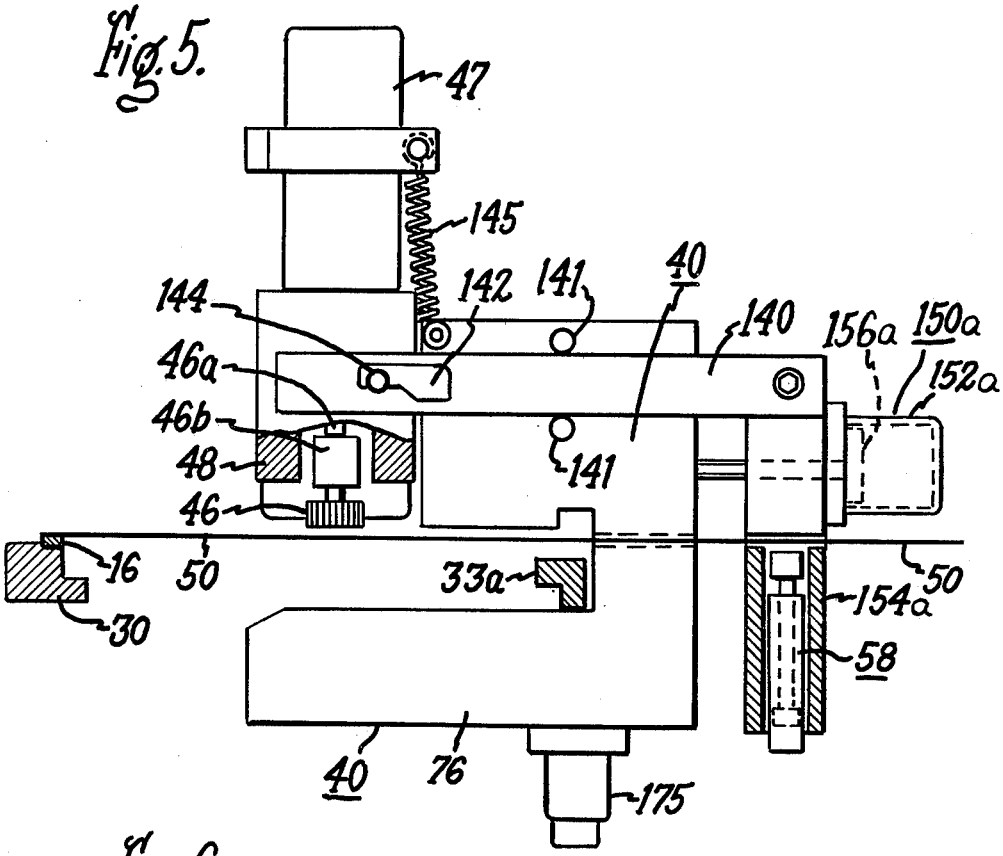
FIG. 5 shows the device of FIGS. 3 and 4 after it has been returned to its position of FIG. 3 but prior to lowering of the milling cutter.
Figure 6A:
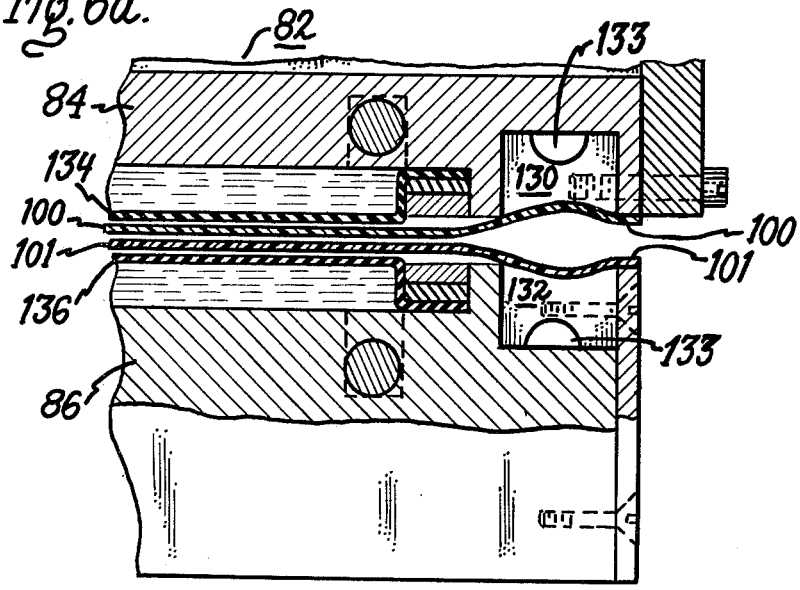
FIG. 6*a* is an enlarged sectional view of a portion of the insulation applicator of FIG. 6.

After the strap 50 has been cold-welded to the wire 16 and the framework 40 has been returned to its normal position of FIG. 5, as above described, the anvil 30 is withdrawn to its retracted, or lower position, following which electrical insulation is applied by an insulation applicator 82 that is located at the same work station as the framework 40. The above-described retracting, or lowering, of the anvil 30 serves to move the anvil into a position where it is out of the way of the insulation applicator 82 when the applicator is moved transversely from its normal position of FIG. 1 onto the wire 16, as will soon be described.

The Insulation Applicator 82

Figures 6, 6B:
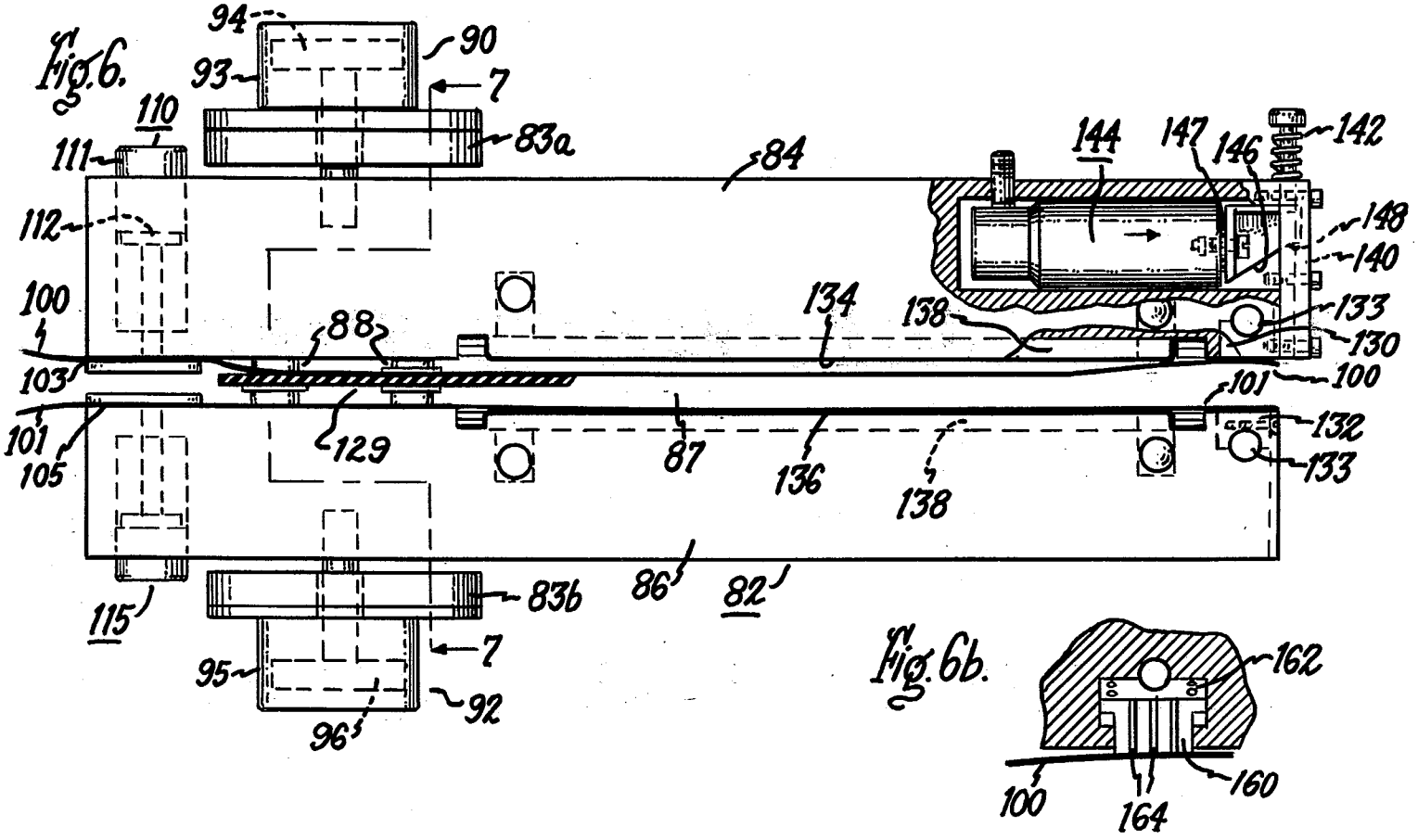
FIG. 6 is a side elevational view, partly in section, of the portion of the apparatus of FIG. 1 used for applying insulation to the lead.
FIG. 6*b* shows a modification of the vacuum system of the applicator of FIGS. 6 and 6*a*.
Figure 7:
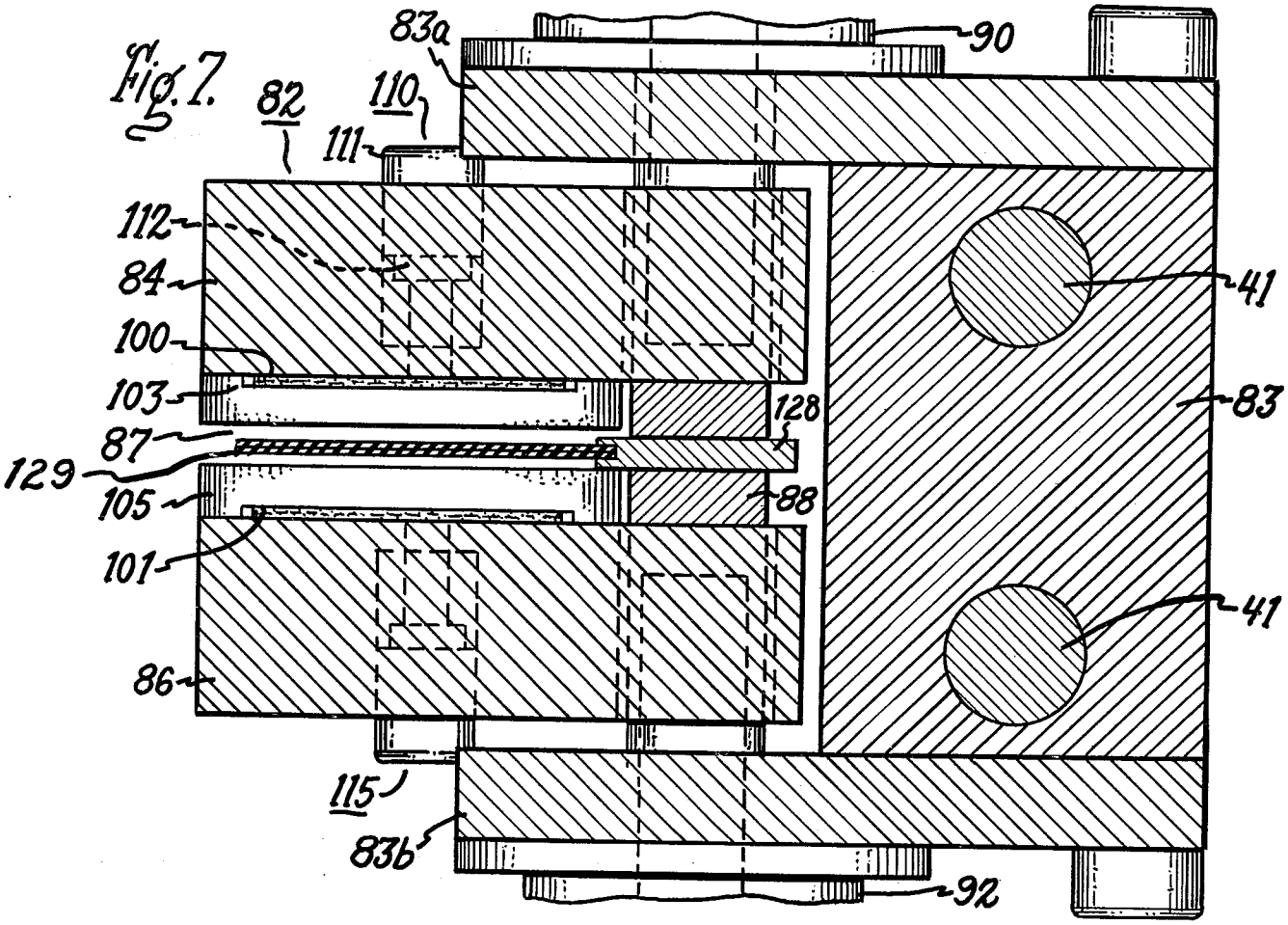
FIG. 7 is a sectional view along the line 7—7 of FIG. 6.

This insulation applicator 82 comprises a support block 83 of U-shaped cross-section as viewed in FIG. 7. This block is slidably mounted for horizontal reciprocation in a direction transverse to the wire 16 by the spaced horizontal guide rods 41. Referring to FIGS. 6 and 7, mounted between the legs 83*a* and 83*b* of the U-shaped block 83 are two vertically spaced applicator segments 84 and 86. These segments are mounted for vertical motion with respect to the block 83 by means of two horizontally-spaced vertical guide rods 88 carried by block 83 and extending through openings in the segments 84 and 86. The segments are shown in FIGS. 6 and 7 in their spaced-apart position, but they can be driven vertically toward each other by two fluid motors, one of which 90 is carried by the upper leg 83*a* of the U-shaped clock 83 and the other of which 92 is carried by the lower leg 83*b* of the U-shaped block 83. There fluid motors 90 and 92 are sometimes referred to herein as the squeeze motors.

As shown in FIG. 6, the upper squeeze motor 90 comprises a cylinder 93 fixed to the upper leg of clock 83 and a piston 94 slidably mounted within the cylinder 93 and coupled to the upper applicator segment 84. The lower squeeze motor 92 comprises a cylinder 95 fixed to the lower leg of block 83 and a piston 96 slidably mounted within cylinder 95 and coupled to the lower applicator segment 86. When the cylinder space above piston 94 and that below piston 96 are pressurized, the applicator segments 84 and 86 are driven together. When these cylinder spaces are vented, the applicator segments are separated by suitable spring means (not shown).

Between the applicator segments 84 and 86 is a feed passage 87 into which are fed two strips 100 and 101 of paper insulation. The upper strip 100 enters feed passage 87 through a slit 103 in a guide portion at the left hand end of the applicator segment 84, and the lower strip 101 enters the feed passage 87 through a similar slit 105 in a guide portion of the lower segment 86.

Each of the paper strips 100 and 101 is the free end of a roll of strip material carried on a stationarily-located storage reel. The upper strip 100 is carried by a reel 120 (FIG. 1) and passes around an idler pulley 121 and then through slit 103 (FIG. 6), into the feed passage 87. The lower strip 101 is carried by a stationarily-located storage reel 124 (FIG. 1) and passes around an idler pulley 126 and then through slit 105 into feed passage 87. The upper strip 100 has an adhesive layer on its lower surface that is not sticky until moderately heated. The lower strip has an identical layer of adhesive on its upper surface. Although it is much preferred that both strips have an adhesive coating, the invention in its broader aspects comprehends the use of an adhesive coating on only one strip.

Each of the paper strips 100 and 101 can be releasably clamped with respect to its associated applicator segment by an associated clamping device 110 or 115. The upper clamping device 110 comprises a cylinder 111 and a plunger 112 slidably mounted therein and having a lower end that is adapted to engage the paper strip 100. When the plunger 112 is forced downward by pressurizing the cylinder space above it, it clamps the strip 100 between its lower end and the lower side of slit 103. The lower clamping device 115 acts in essentially the same manner to clamp the lower strip 101 to the lower applicator segment 86 when its plunger is actuated by pressure applied to the plunger. Each of these clamping devices 110 and 115 will release its associated paper strip when its cylinder space is vented to allow a suitable reset spring to restore the plunger to its normal non-clamping position.

Located in the feed passage 87 midway between the applicator segments 84 and 86 near their left hand end is a stop 128 which is fixedly mounted on the vertical guide rods 88. This stop establishes the minimum spacing allowed between the segments 84 and 86 when they are forced together by the squeeze motors 90 and 92, as will soon be explained.

Carried by the stop 128 and located in the feed passage 87 is a thin separator plate 129 of an adhesion-resistant plastic material, such as Teflon, to which the adhesive on the paper strips will not adhere even when heated. "Teflon" is DuPont's trademark for polytetrafluoroethylene. This Teflon plate serves to prevent the strips 100 and 101 from adhering together in the localized region of the strips where the plate 129 is located during a bonding operation, as will soon appear more clearly.

The two strips 100 and 101 normally extend through the feed passage 87 and have their forward ends held apart by the action of a controllable vacuum system built into the two segments 84 and 86. This vacuum system comprises a vacuum chamber 130 located in upper segment 84 at its forward end and a vacuum chamber 132 located in the lower segment 86 at its forward end. When the vacuum system is on, air is pulled from the vacuum chambers 130 and 132 through exhaust passages 133 and 133 respectively, thus creating a partial vacuum in chambers 130 and 132. When the vacuum system is on and when the material of strips 100 and 101 is located in registry with the vacuum chambers, the pressure differential caused by the partial vacuum in chamber 130 holds the forward end of strip 100 against the lower face of segment 84 and that in chamber 132 holds the forward end of strip 101 against the upper face of segment 86, thus holding the forward ends of insulating strips 100 and 101 apart.

Operation of the Applicator 82

Before the insulating strips 100 and 101 are applied, the clamping devices 110 and 115 are operated to clamp strip 100 to segment 84 and strip 101 to segment 86 and the vacuum systems are turned on to hold the forward ends of the strips apart, as described hereinabove. Then the entire applicator assembly, as viewed in FIG. 6, is moved to the right, thus carrying the paper strips 100 and 101 to the right into positions wherein strip 100 is located just above the upper face of the metal strap 50 and strip 101 is located just below the lower face of the strap 50. The strips 100 and 101 are then also in a position of substantial alignment with strap 50. Because the forward ends of the paper strips 100 and 101 are held apart during this movement to the right, the strips 100 and 101 are readily carried by such movement into positions on opposite sides of strap 50 and of wire 16.

The paper strips 100 and 101 are then brought into close proximity with each other, after which they are forced together while being moderately heated, thereby melting the adhexive on their confronting faces and bonding them together and to the strap 50. For bringing the strips 100 and 101 into close proximity with each other, the squeeze motors 90 and 92 are operated to force the applicator segments 84 and 86 toward each other, thus carrying the strips toward each other. Then the strips are forced together under pressure by the action of two resilient bladders 132 and 134, soon to be described, respectively carried by the two applicator segments.

The upper segment 84 is provided with a bladder 134 bordering the upper surface of feed passage 87, and the low segment 86 is provided with a similar bladder 136 bordering the lower surface of feed passage 87. Behind each bladder, there is a chamber 138 into which pressurized liquid can be introduced. When the paper strips 100 and 101 are properly positioned with respect to the lead strap 50, these chambers are supplied with pressurized hot liquid, preferably oil at a temperature of about 150° C. This forces the bladders together, which, in turn, forces the two strips of paper together, tightly sandwiching the lead 50 between the two strips. This pressure and the heat from the hot liquid behind the bladders bonds the strips 100 and 101 together and also bonds them to opposite faces of the lead 50. The upper strip is tightly bonded to the welded-on end region of the lead 50. Immediately thereafter the hot liquid in the chambers behind the bladders is vented and replaced by cold liquid, which reduces the temperature of the adhesive and thus improves the bond.

During the above-described bonding operation, the right hand ends of the strips 100 and 101 are held slightly spaced apart by the action of the vacuum chambers 130 and 132, and thus these right hand ends do not bond together during the strip-bonding operation. To the left of these ends, however, bonding between the strips occurs along the entire length of the strips (except where the wire 16 intervenes) back to the region where the Teflon separator plate 129 is located. In this latter region the Teflon separator plate keeps the strips 100 and 101 separated and prevents them from adhering to each other. The strips are unable to adhere to the plate 129 since it is of Teflon.

Release of the Strips 100 and 101 after Bonding

As a next step, the paper strips are completely released from the actuator assembly. This release is effected by the following operations: (1) the bladder chambers 138 are vented to allow the resilient bladders 134 and 136 to retract to their normal deflated positions, thus slightly separating the bladders from the paper strips 100 and 101, (2) the vacuum in the vacuum chambers 130 and 132 is released, thus releasing the forward ends of the strips 100 and 101 from the applicator segments 84 and 86, (3) the squeeze motors 90 and 91 are vented to cause the applicator segments 84 and 86 to be withdrawn to their positions of maximum separation, where they are separated by a relatively large distance from the strips 100 and 101, and (4) the clamping motors 111 and 115 are vented to unclamp the strips 100 and 101 from the applicator segments at the left hand end of the applicator assembly.

Withdrawal of the Applicator 82 after Release of the Strips 100 and 101

When the paper strips 100 and 101 have been thus completely released from applicator segments 84 and 86, the entire applicator assembly 82 is withdrawn to the left, leaving the bonded-together strips 100 and 101 in place on the strap 50. Referring to FIG. 6, during this leftward motion, the unbonded portions of the strips 100 and 101 located to the left of the bonded portions slide freely through the slits 103 and 105 at the left hand end of the applicator segments 84 and 86. This leftward motion of the applicator assembly is halted at an intermediate point in the full return stroke of the applicator assembly; and at this intermediate point, the paper strips are cut off and thereby detached from the remainder of the strip material.

Cut-off of the Strips 100 and 101

Just prior to cut-off, however, the paper strips are clamped to the applicator segments 84 and 86 by the clamping devices 111 and 115. Also the segments 84 and 86 are brought together by operation of the squeeze motors 90 and 92. Then cut-off of the strips occurs.

Such cut-off of the strips 100 and 101 occurs at a point on the strips slightly to the left of the left hand terminus of the bonded region of the strips. Referring to FIG. 6, the strips are cut off at this point by a knife blade 140 carried by the upper applicator segment 84 at its right hand end. This knife blade 140 is slidably mounted for vertical motion on segment 84 and is biased upwardly by a compression spring 142 into a retracted position. A fluid motor 144 acting through a cam slot connection is adapted to drive the knife 140 downwardly through its cutting stroke against the opposing bias of spring 142. The cam and slot connection comprises a wedge-shaped cam 146 on the plunger 147 of the fluid motor projecting through a slot 148 on the knife blade 140. When the fluid motor drives its plunger 147 to the right, the cam 146 moves to the right, driving the knife blade 140 downwardly to cut off the strips 100 and 101 at the front of the applicator segments 84 and 86.

After cut-off of the bonded-together portions of strips 100 and 101, there are portions of strip material on the storage reels 120 and 124. For separating the right-hand ends of these still-connected portions of the strip material, the vacuum chambers 130 and 132 are placed under vacuum and this draws these free ends of the strips into engagement with the confronting faces of the applicator segments 84 and 86. Then the squeeze motors 90 and 92 are depressurized, thus causing the applicator segments 84 and 86 to separate. The applicator assembly is then withdrawn further to the left to its normal-at-rest position.

By effecting the above described cut-off of the strips 100 and 101 at a location to the left of the left-hand terminus of the bonded region of the strips, the still-connected portions of the strip material are left completely unbonded to each other and thus their ends are freely separable, as above noted, in preparation for the next strip-applying operation.

It should be noted that cut-off of the strips 100 and 101 occurs at a point located slightly to the left of the left-hand edge of the winding form 14. The opposite ends of the strips are located a substantial distance to the right of the right-hand end of the winding form. thus, the strips 100 and 101 extend for the full length of the winding form 14, and the coil, and project axially beyond the ends of the winding form, and the coil.

Travel Control Means for Applicator 82

Figures 8, 8A, 8B, 8C:
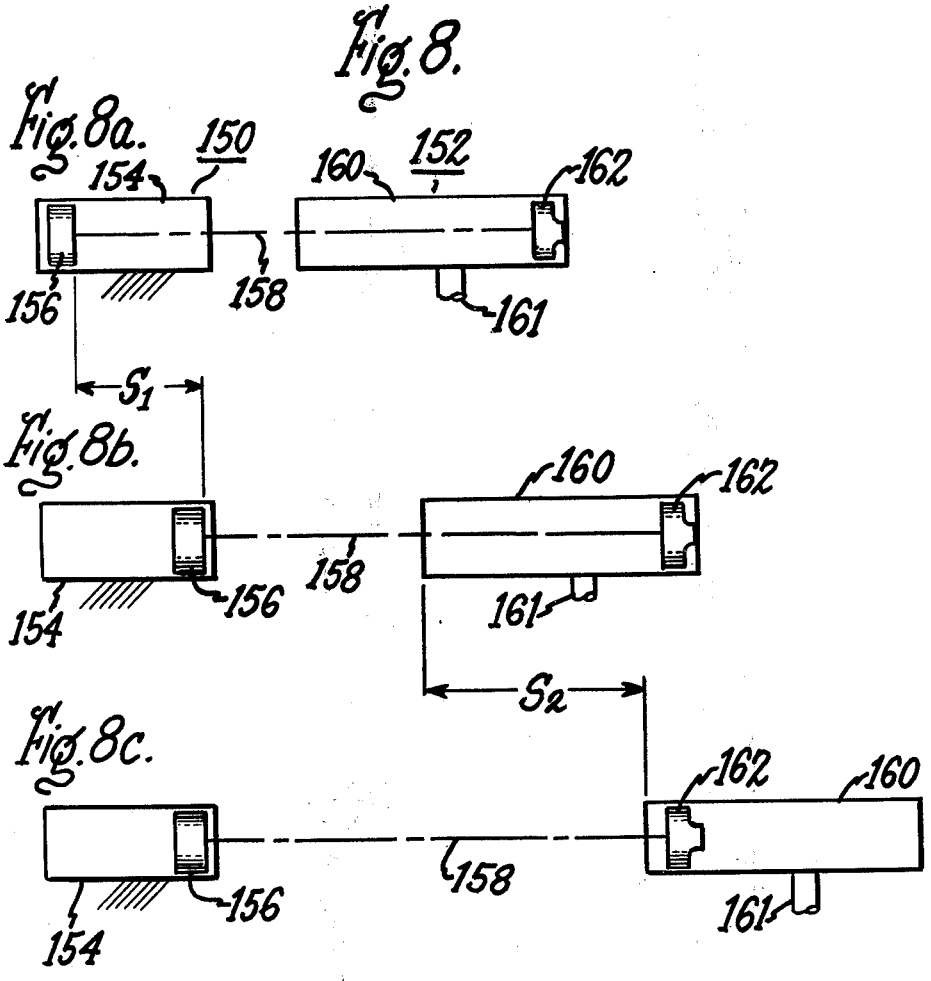
FIG. 8 is a schematic showing of the fluid motors used for positioning the insulation applicator of FIGS. 6 and 7.

For moving the insulation applicator assembly 82 through its stroke so as to properly position it to perform the above-described series of steps, I utilize two fluid motors 150 and 152 shown in FIGS. 1 and 8. Motor 150 is referred to as an auxiliary motor, and it comprises a stationary cylinder 154 and a piston 156 slidable therein and having a piston rod 158 projecting through the right-hand end wall of cylinder 154. Motor 152, which is referred to as a main motor, comprises a cylinder 160 coupled to the actuator assembly through structure 161 and a piston 162 coupled to the piston rod 158, which extends through the left-hand end wall of cylinder 160. FIG. 8*a* shows these parts when they are in their normal-at-rest position. Referring to FIG. 8*a*, when the cylinder space to the left of auxiliary piston 156 is pressurized, piston 156 is driven to the right through a stroke $S_1$, and this moves the piston 162 and the cylinder 160 of the main motor through the same distance to the right into the position of FIG. 8*b*, thereby driving the applicator assembly 82 to the right through the same distance. At the end of the stroke $S_1$, when the parts are in their position of FIG. 8*b*, the space to the right of main piston 162 is pressurized, and this carries the main cylinder 160 and the attached applicator assembly 82 through additional travel $S_2$ to the right into the position of FIG. 8*c*. Such motion of the applicator assembly to the right through distances $S_1$ and $S_2$ carries the applicator assembly 82 from its normal-at-rest position to its extreme right-hand position where the paper strips 100 and 101 are applied to the lead 50, as above described.

On the return stroke, the applicator assembly is driven to the left in two stages, first through travel $S_2$, immediately following which the paper strips 100 and 101 are cut off as described hereinabove, and then through an additional distance $S_1$ to return the applicator assembly to its normal-at-rest position of FIGS. 8*a*, 1 and 6.

Referring to FIG. 8*c*, for driving the applicator assembly to the left through its first stage of return motion, i.e., through travel $S_2$, as above-described, the cylinder space to the left of the auxiliary piston 162 is pressurized and that to its right is depressurized, restoring the parts to the position of FIG. 8*b*. For driving the applicator assembly to the left from its position of FIG. 8*b* through the second stage, i.e., through travel $S_1$, the cylinder space to the left of auxiliary piston 156 is depressurized and that to its right is pressurized, and the cylinder space to the right of main piston 162 is pressurized, thus driving pistons 156 and 162 further to the left into their original positions of FIG. 8*a* and restraining them against rightward movement. When main piston 162 is so restrained, the pressure to the left of the main piston 162 acts on the cylinder 160 to restore the cylinder to the left to its original position of FIG. 8*a*.

General Discussion of Applicator 82

The use of resilient bladders (134 and 136) for applying heat and pressure to the strips 100 and 101 during bonding is especially advantageous for several reasons. First, since the bladders are elastic, or resilient, they can closely conform to the juxtaposed surface of the strips and can therefore apply force at substantially all points along these surfaces, thus promoting a good bond along most of the juxtaposed confronting surfaces of the strips and also where the strips are in juxtaposition to the lead 50. Secondly, the bladders can be activated by a liquid (in chambers 138) and can be quickly heated and cooled by switching from a hot to a cool liquid and vice versa.

The bladders, however, cannot be relied upon to always return to exactly their same original positions when depressurized. There may be some distortion as a result of repetitive pressurization and depressurization. Such distortion will tend to produce friction between the bladders and the paper strips 100, 101 during withdrawal of the segments 84 and 86 to the left and will also tend to displace the wire 16 unless the segments 84 and 86 are separated from the close-together positon they occupy during the bonding operation. It is primarily for this reason that I mount the segments for relative separating and engaging motion with respect to each other and provide squeeze motors 90 and 92 for driving them through such separating and engaging motion.

If longer temperature cycling times are available, I can use, instead of the bladders, solid resilient material with suitable heating means imbedded therein, e.g., pipes for carrying liquid or even electric heating elements. I much prefer, however, to use the bladders for this purpose.

The vacuum system 130–133 constitutes a simple and effective means for keeping the free ends of the strips 100 and 101 separated so that they can readily be carried into positions at opposite sides of the lead 50. the vacuum system is able to do this without deforming or damaging the paper strips, and this is advantageous. To improve the effectiveness of the vacuum system, I prefer to provide as shown in FIG. 6*b*, a floating plug 160 in each vacuum chamber that is biased toward a projecting position by a light compression spring 162. Referring to FIG. 6*b*, when the space within the vacuum chamber at the upper side of the plug 160 is evacuated, surrounding air rushes through small passages 164 extending through the plug, tending to suck the associated paper strip 100 up against the lower face of the plug. The presence of plug 160 facilitates pick-up of the strip by the vacuum system even though the strip might initially be spaced from the lower face of the segment 84 since the plug will project downwardly sufficiently to touch the strip and produce a pressure differential on the strip when the vacuum system is turned on.

Cut-Off of Strap 50 to Complete the Lead

After the insulating strips 100 and 101 have been applied to the conductive strap 50 as hereinabove described, the strap is cut off at a point beyond the right-hand end of the insulating strips to complete the lead. The framework 40 is then in its position of FIG. 5. This cut-off operation is effected by a fluid motor 175 that comprises a cylinder 176 carried by framework 40, a plunger 178 within the cylinder 176, and a blade 179 carried by the plunger at its upper end, as best shown in FIG. 3. When the cylinder space beneath plunger 178 is pressurized, the plunger and blade 179 are driven upwardly, the upper edge of the blade passing through the thin strap 50 into a recess 180, thus effecting the desired cutting operation. Then, the cylinder space beneath the plunger 178 is vented, and a compression spring (not shown) restores the plunger to its normal depressed position.

Resetting the Remaining Strap Material 50 in Preparation for the Next Lead-Applying Operation After the metal strap 50 has thus been cut-off to form a lead, the coil-winding operation is resumed and the lead is thus carried with wire 16 out of the work station and toward the coil being wound. The free end of the remaining strap material 50 is then fed to the left into its position of FIG. 3 from its position of FIG. 5. This feeding action is effected by operating the clamping device 58 to clamp the strap to the subframe 154*a*. Then the motor 150*a* of the subframe is reset by depressurizing cylinder space to the right of plunger 156*a*, thereby allowing its reset spring to drive cylinder 152*a* and the subframe 154*a* to the left into their position of FIG. 3. This leftward motion of subframe 154*a* with strap material 50 clamped thereto properly positions the strap material in the correct initial position for the next lead-applying operation.

The Finished Lead 50 with Applied Insulation 100, 101

Figure 9:
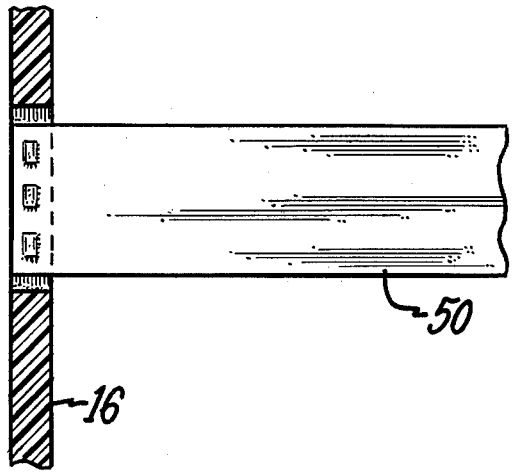
FIG. 9 is an enlarged plan view of the wire and the tap attached thereto.
Figure 10:
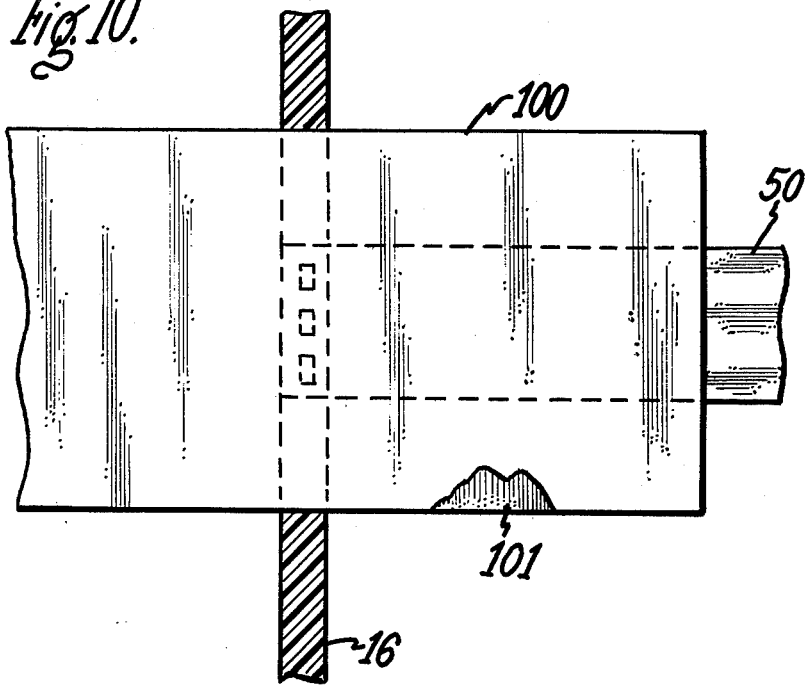
FIG. 10 shows the structure of FIG. 9 after insulation has been applied thereto.
Figure 11:
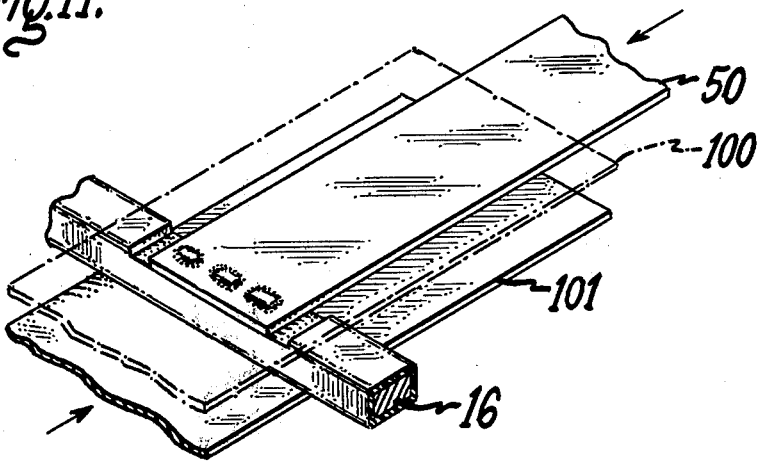
FIG. 11 is a perspective view of the insulated tap of FIG. 10.

FIGS. 9, 10, and 11 show the lead 50 attached to the wire 16 and the insulating strips 100 and 101 applied to the lead. It will be noted that the insulating strips 100 and 101 are disposed adjacent the opposite faces of the lead and cover the lead along its entire length except for its outer end, which is left bare to facilitate making an electrical connection to the lead. The insulating strips also cover the cold-weld between the wire and the lead and extend transversely of the wire 16 on both sides of the wire.

That portion of the two insulating strips 100 and 101 which is located on the opposite side of the wire 16 from the lead 50 serves to make the build-up of the coil diameter resulting from inclusion of the lead substantially uniform along the length of the coil layer. This will be apparent from FIG. 12 which schematically shows, in slightly exploded form, a cross-section through two layers $L_1$ and $L_2$ of a coil having a lead 50 attached to an internal turn 180 in the inner layer $L_1$. In the high voltage winding of a distribution transformer, encircling each layer will be the usual wrap of insulating paper. The wrap around the layer $L_1$ is shown at 182. It will be noted that, in the illustrated cross-sectional plane, the turns of outer layer $L_2$ to the left of turn 180 are spaced from the winding form 14 by a total distance D equal to the thickness of the layer $L_1$ plus the thickness of the two insulating strips 100 and 101 plus the thickness of paper wrap 182. To the right of turn 180, the turns of outer layer $L_2$ are spaced from the winding form 14 by the same distance D plus the thickness of the lead 50. The lead thickness is typically only about 0.010 to 0.030 inches. So for all practical purposes, in the illustrated cross-sectional plane, the layer $L_2$ is spaced substantially the same distance from the winding form 14 along the entire length of the coil.

In FIG. 12, the lead 50 is shown as being encircled by the turns of layer $L_1$ to the right of turn 180. This is because these turns of layer $L_1$ are applied after turn 180 is applied since this layer $L_1$ is applied proceeding from the left-hand end of the coil to the right. But if a lead such as 50 was applied to next layer, e.g., layer $L_2$, the lead would be located radially outside the already applied turns, and the paper strips 100 and 101 on the opposite side of the weld to wire 16 would be encircled by the subsequently applied turns of the layer $L_2$. Even if the lead 50 and paper strips 100 and 101 are located in this latter manner with respect to the turns, the build-up in coil diameter resulting from inclusion of the lead is still substantially uniform along the length of the coil.

It is to be noted that at the right-hand end of the coil, the portions of paper strips 100 and 101 that project beyond the right-hand end of the coil are not bonded together. This permits these ends to be separated when the coil is to be placed in use so that the usual insulating tube (not shown) applied around the external portion of the lead can fit between these separated ends of the paper strips, thus providing the desired fit between the strips and the tube.

Additional leads that may be required for any coil that is being wound will be applied to wire 16 at the desired locations on the wire in the same manner as described for the single lead described hereinabove. The length of the various leads will vary depending upon where the inner end of a given lead is attached to the coil. This lead length will correspond to the distance moved by framework 40 from its at-rest position of FIG. 1 to where the anvil 30 is then located, the anvil serving as a stop to limit leftward motion of the framework 40, as hereinabove described. Although the leads 50 will thus vary in length, the strips of paper insulation 100 and 101 will be of constant length for each lead, as described hereinabove.

Although the above description focuses especially on the making of a lead applied to an internally-located turn, i.e., a tap, it is to be understood that the same apparatus and the same method are used for making a lead applied to an end turn. When the end of the coil is approached, two leads are applied to wire 16 in the same manner as above described in locations slightly spaced apart along the length of the wire; and the wire is severed between these two leads. The first one of these two leads serves as the last lead on the coil that is being completed, and the next one of these leads serves as the first lead on the next coil that is to be wound by the machine.

The controls for initiating the various operations described hereinabove have not been disclosed in detail because such details are not considered to be a part of this invention and furthermore would be readily apparent to one of ordinary skill seeking to make this apparatus with this disclosure before him as a guide. It will be readily apparent to such a person that suitable valves can be used for initiating the various fluid-motor controlled operations and suitable switches for initiating the various electrically-controlled operations. The winding operation is pre-programmed to be stopped at the point where the leads are to be applied, and the various other operations are initiated by controls that respond to suitable indicators signalling when the immmediately-preceding operation in the hereinabove-described sequence has been completed.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. A method of making a coil from conductive wire having an insulating coating bonded thereto and for providing the coil with at least one conductive lead, comprising the steps of:

a. winding said coated wire about a coil axis while advancing the wire along its length past a work station, b. stopping the winding operation when a predetermined region of the wire is located at said work station, c. removing a section of said insulating coating from said predetermined region of said wire located at said station, thereby exposing a section of bare wire at said station, d. placing in contact with said section of bare wire a thin conductive strap that extends transversely of said wire at said station and forms said lead, e. cold-welding said strap to said section of bare wire by forcing said strap against said bare section with a force that produces metal flow and a resulting cold-weld joint at the interface of said strap and said bare section, f. covering said joint and a portion of said lead with electrical insulation by applying to opposite faces of said lead two strips of insulating material that extend transversely of said wire for substantial distances on opposite sides of said wire, g. bonding said strips of insulating material together, and h. continuing said winding operation to further form said coil with said strips of insulating material extending generally parallel to said coil axis.

2. The method of claim 1 in which said section of insulating coating is removed in accordance with (c) of claim 1 by a machining operation performed on said wire.

3. The method of claim 1 in which:

(a) said conductive strap is placed in contact with said section of bare wire as specified in (d) of claim 1 by lead-applying structure that is moved transversely of said wire at said work station, and (b) said section of insulating coating is removed in accordance with (c) of claim 1 by a cutter carried across said wire by said transverse movement of said lead-applying structure.

4. A machine for making a coil from conductive wire having an insulating coating bonded thereto and for providing the coil with at least one conductive lead, comprising:

a. winding means for winding said coated wire about a coil axis while advancing the wire along its length past a work station, b. means for stopping the winding operation when a predetermined region of the wire is located at said work station, c. a framework located at said work station which is reciprocably movable in a direction transverse to the wire at said work station, d. insulation-removing means mounted on said framework and operable to remove a section of said insulating coating from said predetermined region of said wire when said framework is moved in one direction transversely of said wire, thereby exposing a section of bare wire at said station, e. means for releasably fixing to said framework a thin conductive lead-forming strap so that when said framework is moved in said one transverse direction, it carries said conductive strap into a position where it can contact said bare section of wire, f. means carried by said framework for producing a cold weld between said conductive strap and said section of bare wire when said strap has been carried by said framework into a position where the strap can contact said section of bare wire, g. means for moving said framework in a transverse direction opposite to said one direction following said cold welding operation, h. means for releasing said conductive strap from said framework prior to motion of the framework in said opposite transverse direction, whereby said wire is not transversely displaced by said opposite transverse motion of the framework, i. means for carrying two strips of insulating material transversely of said wire and for applying said strips to opposite faces of said conductive strap in such positions that said strips extend transversely of said wire for substantial distances on opposite sides of said wire, j. means for bonding said strips of insulating material together, with said conductive strap sandwiched therebetween, k. and means for causing said winding means to continue said coil winding operation after said strips of insulating material have been applied to said strap, thereby providing a coil in which said strips of insulation extend generally parallel to said coil axis.

5. The machine of claim 4 in which means is provided for retracting said insulation-removing means to a position where said insulation-removing means will be out of contact with said strap during said opposite transverse movement of (g), claim 4.

6. The machine of claim 4 in which said insulation-removing means of (d) comprises a rotatable cutter mounted on said framework.

7. The machine of claim 4 in which said insulation-removing means of (d) comprises a rotatable cutter mounted on said framework and in which there is provided:

a. means for retracting said cutter to a position where the cutter will be out of contact with said strap during said opposite transverse movement of (g), claim 4, and b. means operable after occurrence of said opposite transverse movement for restoring said cutter to a position where the cutter will again be effective to remove insulating coating from said wire during the transverse framework movement of (d), claim 4 in said one direction.

8. The machine of claim 4 in which the strip-carrying and applying means of (i) and the bonding means of (j) comprise the following:

a. a pair of applicator segments between which is located a feed passage through which said two strips are fed, at least one of said two strips having on its face confronting the other strip normally non-sticky adhesive that can be rendered sticky by heating said adhesive, b. means for moving said segments transversely of said wire from a first position where the forward ends of said segments are located at one side of said wire to a second position where: (i) the forward ends of said segments are located at the opposite side of said wire and (ii) said conductive strap is positioned in said feed passage, c. holding means on said segments for releasably holding said strips respectively to said segments while the strips extend through said feed passage, said holding means acting to releasably hold apart the forward ends of said strips when the segments are in their first position and while the segments are being moved to said second position, d. resilient means adapted when activated to force said strips together, e. means operable when said segments have been moved into said second position for activating said resilient means and for heating said resilient means thereby then forcing said strips together about said lead and rendering said adhesive sticky through heat so that the strips are then bonded together, f. means operable after said strips are bonded together for inactivating said holding means to release said strips from said segments, g. means for returning said segments toward said first position after said strips have been released, and h. means for cutting off said paper strips at a location at said one side of said wire after said strips have been bonded together.

9. A machine as defined in claim 4 for making a coil comprising a plurality of generally concentric tubular layers, each layer comprising a plurality of turns, and in which said winding means causes:

a. said predetermined region of said wire to be located in one layer that is surrounded by another layer, b. said strips of insulating material to be located radially outwardly of the turns in said one layer made before said predetermined region of said wire enters said coil and radially inwardly of the turns made in said one layer after said predetermined region enters said coil.

10. A machine for making a coil from conductive wire having an insulating coating bonded thereto and for providing the coil with at least one conductive lead, comprising:

a. winding means for winding said coated wire about a coil axis while advancing the wire along its length past a work station, b. means for stopping said winding operation when a predetermined region of the wire is located at said work station, c. means for welding to said predetermined region of the wire a thin conductive lead-forming strap, d. means for applying to said strap two strips of insulation located at opposite sides of said strap comprising an insulation applicator that comprises the following components d1 through d8:

d1. a pair of applicator segments between which is located a feed passage through which said two strips of insulation are fed, at least one of said two strips having on its face confronting the other strip normally non-sticky adhesive that can be rendered sticky by heating said adhesive, d2. means for moving said segments transversely of said wire from a first position where the forward ends of said segments are located at one side of said wire to a second position where: (i) the forward ends of said segments are located at the opposite side of said wire and (ii) said conductive strap is positioned in said feed passage, d3. holding means on said segments for releasably holding said strips respectively to said segments while the strips extend through said feed passage, said holding means acting to releasably hold apart the forward ends of said strips when the segments are in said first position and while the segments are being moved to said second position, d4. resilient means adapted when activated to force said strips together, d5. means operable when said segments have been moved into said second position for activating said resilient means and for heating said resilient means thereby then forcing said strips together about said conductive strap and rendering said adhesive sticky through heat so that the strips are then bonded together, d6. means operable after said strips are bonded together for inactivating said holding means to release said strips from said segments, d7. means for returning said segments toward said first position after said strips have been released, and d8. means for cutting off said strips at a location at said one side of said wire after said strips have been bonded together, e. and means for causing said winding means to continue said coil winding operation after said strips of insulating material have been applied to said strap, thereby providing a coil in which said strips of insulating material extend generally parallel to said coil axis.

11. The machine of claim 10 in which said resilient means comprises bladder means on said segments in locations bordering said feed passage and inflatable to force said strips together and in which means is provided for supplying a hot fluid to said bladders to inflate the bladders and also render said adhesive sticky so that the strips are then bonded together.

12. The machine of claim 10 in which said holding means comprises vacuum chamber means respectively located on said segments, evacuation of said vacuum chamber means acting to produce a pressure differential on said strips which forces said strips against said segments, thereby holding the strips to said segments.

13. A machine for making a coil from conductive wire having an insulating coating bonded thereto and for providing the coil with at least one conductive lead, comprising:

a. winding means for winding said coated wire about a coil axis while advancing the wire along its length past a work station, b. means for stopping the winding operation when a predetermined region of the wire is located at said work station, c. a framework located at said work station which is reciprocably movable in a direction transverse to the wire at said work station, d. insulation-removing means operable to remove a section of said insulating coating from said predetermined region of said wire, thereby providing a section of bare wire at said station, e. means for releasably fixing to said framework a thin conductive lead-forming strap so that when said framework is moved in said one transverse direction, it carries said conductive strap into a position where it can contact said bare section of wire, f. means carried by said framework for producing a cold weld between said conductive strap and said section of bare wire when said strap has been carried by said framework into a position where the strap can contact said section of bare wire, g. traversing mechanism cooperating with said wire before the wire enters the coil for shifting the wire along the longitudinal axis of the coil so that the coil is wound in layers, said traversing mechanism comprising wire-guiding traversing structure that moves axially of the coil in one direction while one layer is wound and in the opposite direction while the next layer is wound, h. framework stop means for stopping transverse movement of said framework in preparation for a cold-welding operation, i. means for coupling said framework stop means to said traversing structure so that said framework stop means moves through traversing movement with said traversing structure and is located to effect stopping of said framework in a position wherein said cold weld means is aligned with said wire and is then located to effect a weld between said strap and said wire, j. an anvil for supporting said wire during said cold-welding operation, k. anvil-operating means for moving said anvil before a welding operation from a retracted position into a supporting position with respect to said wire and for restoring the anvil to said retracted position after a welding operation, l. means for mounting said anvil with respect to said traversing structure so that said anvil moves through traversing motion with said traversing structure and is located in a position to support said wire when said anvil-operating means is operated, m. means for carrying two strips of insulating material transversely of said wire into positions at opposite faces of said conductive strap, and n. means for causing said anvil-operating means to move said anvil from its retracted position to its wire-supporting position before said framework is moved through its forward stroke transversely of said wire and for causing said anvil-operating means to restore said anvil toward its retracted position after said framework is returned toward its normal position and before said strips of insulating material are carried into said position at opposite faces on said conductive strap.

* * * * *